US007518583B2

(12) United States Patent
Lee et al.

(10) Patent No.: US 7,518,583 B2
(45) Date of Patent: Apr. 14, 2009

(54) IMPULSIVE DRIVING LIQUID CRYSTAL DISPLAY AND DRIVING METHOD THEREOF

(75) Inventors: Chang-Hun Lee, Yongin-si (KR); So-Youn Park, Suwon-si (KR); Jong-Lae Kim, Seoul (KR); Cheol-Woo Park, Suwon-si (KR); Sang-Wook Yoo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 715 days.

(21) Appl. No.: 11/017,537

(22) Filed: Dec. 20, 2004

(65) Prior Publication Data

US 2005/0157559 A1 Jul. 21, 2005

(30) Foreign Application Priority Data

Dec. 19, 2003 (KR) ..... 10-2003-0093845

(51) Int. Cl.
*G09G 3/36* (2006.01)

(52) U.S. Cl. ..... 345/87; 345/94; 345/95; 345/96; 345/97; 345/98; 345/99

(58) Field of Classification Search ..... 345/87, 345/94–99

See application file for complete search history.

(56) References Cited

U.S. PATENT DOCUMENTS

| | | | | |
|---|---|---|---|---|
| 6,236,385 | B1 * | 5/2001 | Nomura et al. | 345/95 |
| 2002/0044117 | A1 * | 4/2002 | Matsumura et al. | 345/87 |
| 2003/0090449 | A1 * | 5/2003 | Arimoto et al. | 345/87 |
| 2006/0176261 | A1 * | 8/2006 | Nitta et al. | 345/94 |
| 2007/0085794 | A1 * | 4/2007 | Kawabe et al. | 345/89 |

* cited by examiner

*Primary Examiner*—Richard Hjerpe
*Assistant Examiner*—Leonid Shapiro
(74) *Attorney, Agent, or Firm*—F. Chau & Assoc., LLC

(57) ABSTRACT

A liquid crystal display is provided, which includes: groups of gate lines transmitting a gate-on voltage; data lines alternately transmitting normal data voltages and an impulsive data voltage; pixels arranged in a matrix and including switching elements that are connected to the gate lines and the data lines and turn on in response to the gate-on voltage to transmit the data voltages; gate driving circuits connected to respective groups of gate lines and sequentially applying the gate-on voltage to the gate lines; a data driver applying the data voltages to the data lines; a duty ratio selector outputting a duty ratio selection signal informing a selected duty ratio; and a signal controller controlling the gate driver and the data driver based on the duty ratio selection signal, wherein the signal controller determines a time for the application of the impulsive data voltage based on the duty ratio selection signal.

15 Claims, 8 Drawing Sheets

IMPULSIVE DRIVING LIQUID CRYSTAL DISPLAY AND DRIVING METHOD THEREOF

BACKGROUND OF THE INVENTION (a) Field of the Invention

The present invention relates to a liquid crystal display and a driving method thereof, and in particular, to an impulsive driving liquid crystal display and a driving method thereof.

(b) Description of Related Art

A liquid crystal display (LCD) includes a pair of panels provided with field generating electrodes and a liquid crystal (LC) layer having dielectric anisotropy, which is disposed between the two panels. The field generating electrodes generally include a plurality of pixel electrodes arranged in a matrix and connected to switching elements such as thin film transistors (TFTs) to be supplied with data voltages every row and a common electrode covering an entire surface of a panel and supplied with a common voltage. A pair of field generating electrodes that generate the electric field in cooperation with each other and a liquid crystal disposed therebetween form so called a liquid crystal capacitor that is a basic element of a pixel along with a switching element.

The LCD applies the voltages to the field generating electrodes to generate electric field to the liquid crystal layer, and the strength of the electric field can be controlled by adjusting the voltage across the liquid crystal capacitor. Since the electric field determine the orientations of liquid crystal molecules and the molecular orientations determine the transmittance of light passing through the liquid crystal layer, the light transmittance is adjusted by controlling the applied voltages, thereby obtaining desired images.

In order to prevent image deterioration due to long-time application of the unidirectional electric field, etc., polarity of the data voltages with respect to the common voltage is reversed every frame, every row, or every pixel.

The polarity inversion of the data voltages increases the charging time of the liquid crystal capacitor since the response time of the liquid crystal is not so fast. Therefore, it takes long time for the liquid crystal capacitor to reach a target luminance (or target voltage) such that an image displayed by the LCD is unclear and blurred.

In order to solve this problem, impulsive driving that inserts a black image for a short time between normal images is developed.

The impulsive driving includes an impulsive emission type driving that periodically lights off a backlight lamp to yield black images and a cyclic resetting type driving that periodically applies a black data voltage for making the pixels in a black state to the pixels between the applications of normal data voltages.

However, the impulsive emission type controls several backlight lamps using the same number of inverters to increase the cost. The cyclic resetting type driving may decrease the time for applying normal data voltages for displaying normal images such that the liquid crystal capacitor do not reach a target luminance. In addition, the cyclic resetting type requires a frame memory for storing normal data corresponding to the normal data voltages.

SUMMARY OF THE INVENTION

A motivation of the present invention is to solve the problems of conventional techniques.

An impulsive driving liquid crystal display is provided, which includes: a plurality of groups of gate lines transmitting a gate-on voltage; a plurality of data lines alternately transmitting normal data voltages and an impulsive data voltage; a plurality of pixels arranged in a matrix and including switching elements that are connected to the gate lines and the data lines and turn on in response to the gate-on voltage to transmit the data voltages; a plurality of gate driving circuits connected to respective groups of gate lines and sequentially applying the gate-on voltage to the gate lines; a data driver applying the data voltages to the data lines; a duty ratio selector outputting a duty ratio selection signal informing a selected duty ratio; and a signal controller controlling the gate driver and the data driver based on the duty ratio selection signal, wherein the signal controller determines a time for the application of the impulsive data voltage based on the duty ratio selection signal.

The signal controller may supply a plurality of output enable signals defining duration of the gate-on voltage to respective gate driving circuits, and the output enable signal may have a first waveform for blocking the impulsive data voltage and a second waveform for blocking the normal data voltages.

One of the output enable signals having the first waveform may be supplied to one of the gate driving circuits and another of the output enable signals having the second waveform may be supplied to another of the gate driving circuits.

The signal controller may supply a scanning start signal instructing to start scanning of the gate-on voltage to one of the gate driving circuits, the scanning start signal may include normal data pulses for the application of the normal data voltages and impulsive data pulses for the application of the impulsive data voltage, and the signal controller may vary generation time of the impulsive data pulses of the scanning start signal depending on the duty ratio selection signal.

The duty ratio selector may include a plurality of dip switches.

The liquid crystal display may further include an inversion selector outputting an inversion selection signal informing a selected inversion type to the signal controller. The signal controller may supply an inversion signal for inversion of polarity of the data voltages to the data driver and the inversion signal is varied depending on the inversion selection signal. The inversion type may include one dot inversion and two dot inversion.

The impulsive data voltage may include either a white data voltage or a black data voltage.

Sum of the application durations of the normal data voltages and the impulsive data voltage adjacent to each other may be equal to one horizontal period.

An impulsive driving liquid crystal display is provided, which includes: a plurality of groups of gate lines transmitting a gate-on voltage; a plurality of data lines alternately transmitting normal data voltages and an impulsive data voltage; a plurality of pixels arranged in a matrix and including switching elements that are connected to the gate lines and the data lines and turn on in response to the gate-on voltage to transmit the data voltages; a plurality of gate driving circuits connected to respective groups of gate lines and sequentially applying the gate-on voltage to the gate lines; and a data driver applying the data voltages to the data lines, wherein the pixels include first and second pixels connected to different gate driving circuits through the gate lines, the first and the second pixels are supplied with the normal data voltages and the impulsive data voltage, respectively, and the second pixels are determined by the duty ratio selection signal.

A method of impulsive driving a liquid crystal display including a plurality of pixels, the pixels arranged in a matrix and including switching elements connected to gate lines and data lines using a plurality of gate driving circuits that apply a gate-on voltage for turning on the switching elements to the gate lines is provided, which includes: determining a starting time for applying an impulsive data voltage based on supplied information; alternately applying normal data voltages and the impulsive data voltage; applying the gate-on voltage to the gate lines to supply the normal data voltages to the pixels connected thereto; and applying the gate-on voltage to at least one of the gate lines to supply the impulsive data voltage to the pixels connected thereto.

Sum of the application durations of the normal data voltages and the impulsive data voltage adjacent to each other may be equal to one horizontal period.

BRIEF DESCRIPTION OF THE DRAWINGS

The present invention will become more apparent by describing embodiments thereof in detail with reference to the accompanying drawing in which.

DETAILED DESCRIPTION OF THE PREFERRED EMBODIMENTS

Figure 1:
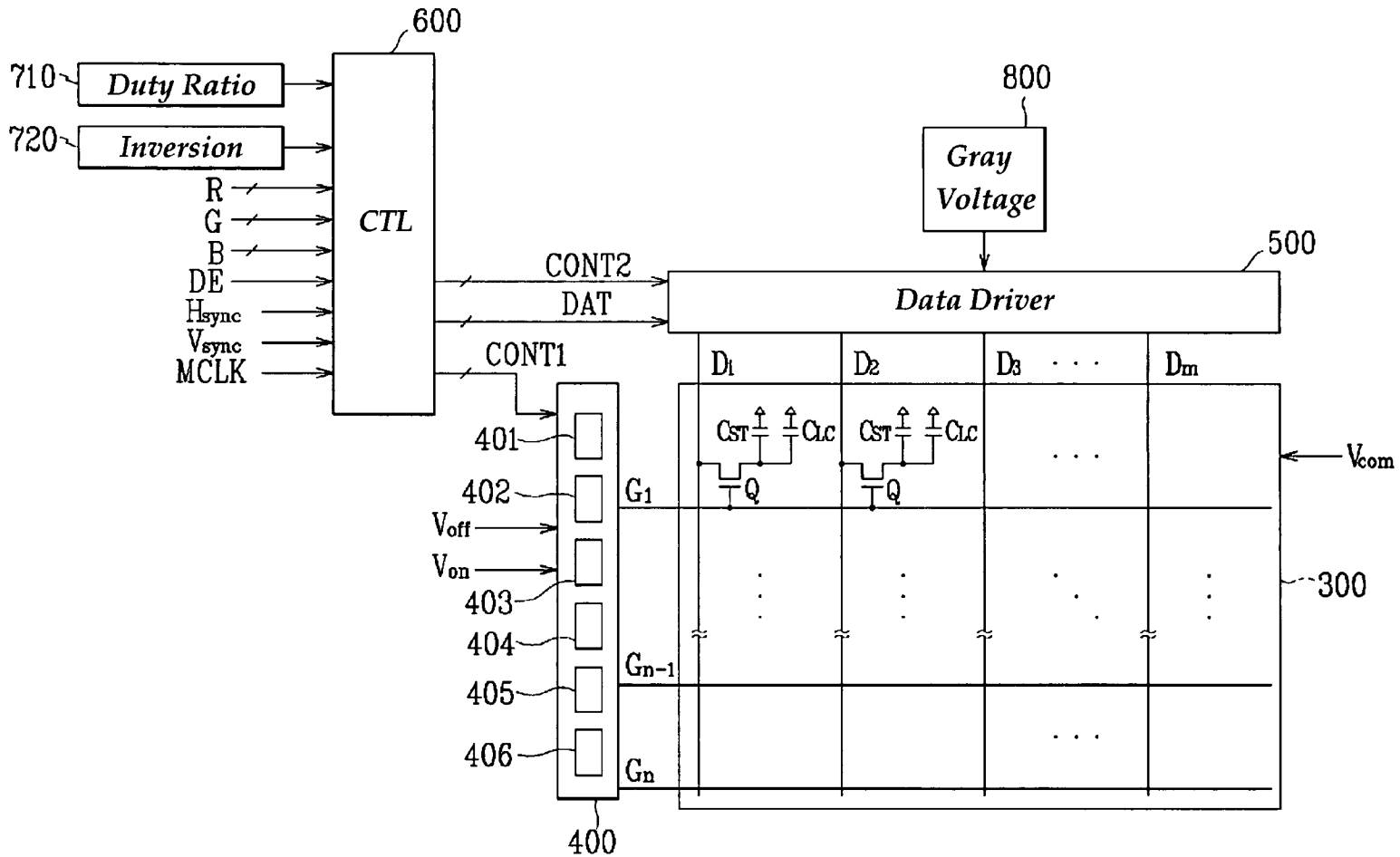
FIG. 1 is a block diagram of an LCD according to an embodiment of the present invention.

The present invention now will be described more fully hereinafter with reference to the accompanying drawings, in which preferred embodiments of the invention are shown.

In the drawings, the thickness of layers and regions are exaggerated for clarity. Like numerals refer to like elements throughout. It will be understood that when an element such as a layer, region or substrate is referred to as being "on" another element, it can be directly on the other element or intervening elements may also be present. In contrast, when an element is referred to as being "directly on" another element, there are no intervening elements present.

Then, liquid crystal displays and driving methods thereof according to embodiments of the present invention will be described with reference to the accompanying drawings.

Figure 2:
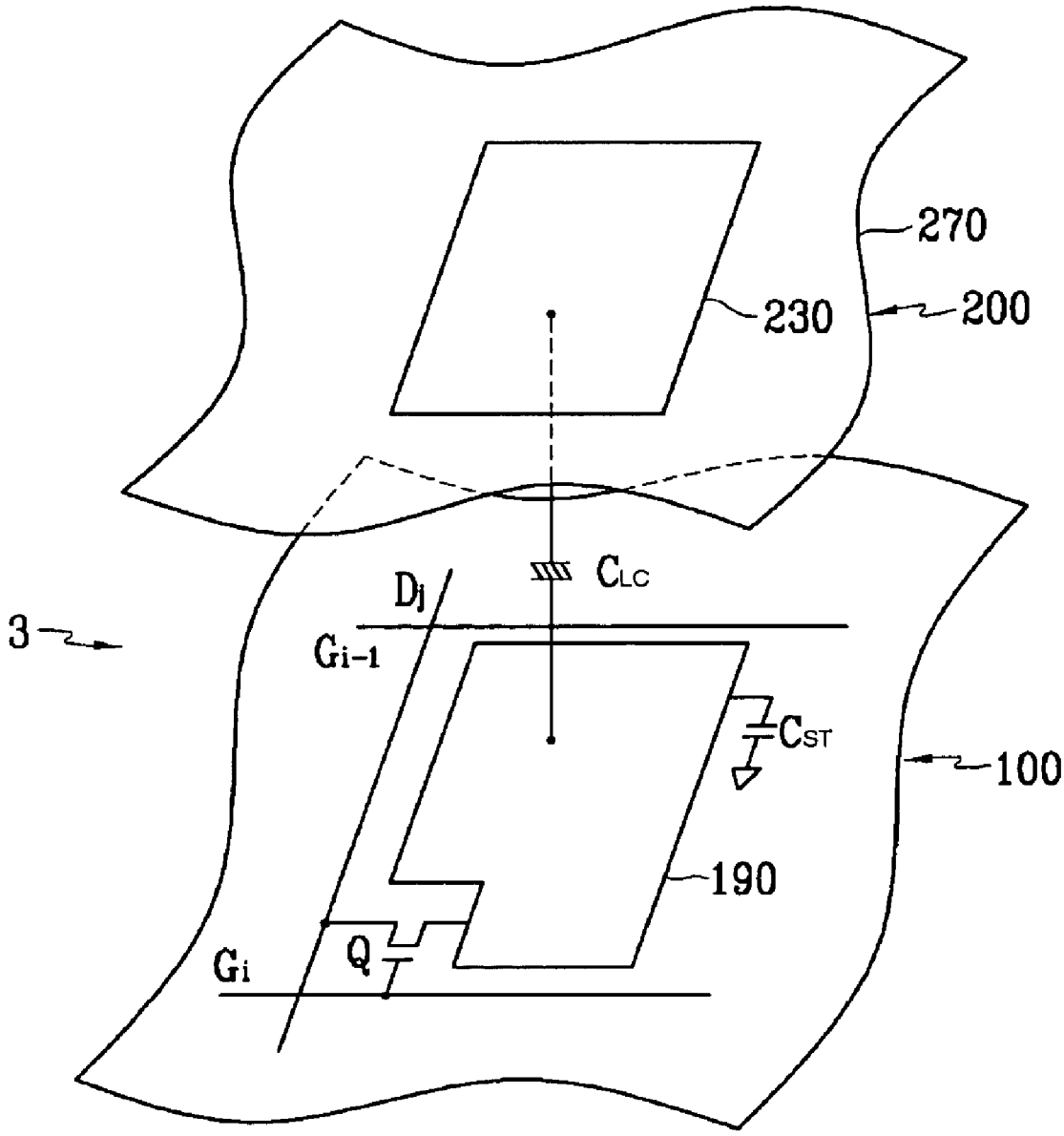
FIG. 2 is an equivalent circuit diagram of a pixel of an LCD according to an embodiment of the present invention.

FIG. 1 is a block diagram of an LCD according to an embodiment of the present invention, and FIG. 2 is an equivalent circuit diagram of a pixel of an LCD according to an embodiment of the present invention.

Referring to FIG. 1, an LCD according to an embodiment includes a LC panel assembly 300, a gate driver 400 and a data driver 500 that are connected to the panel assembly 300, a gray voltage generator 800 connected to the data driver 500, a duty ratio selector 710, an inversion selector 720, and a signal controller 600 controlling the above elements.

Referring to FIG. 1, the panel assembly 300 includes a plurality of display signal lines $G_1$-$G_n$ and $D_1$-$D_m$ and a plurality of pixels connected thereto and arranged substantially in a matrix. In a structural view shown in FIG. 2, the panel assembly 300 includes lower and upper panels 100 and 200 and a LC layer 3 interposed therebetween.

The display signal lines $G_1$-$G_n$ and $D_1$-$D_m$ are disposed on the lower panel 100 and include a plurality of gate lines $G_1$-$G_n$ transmitting gate signals (also referred to as "scanning signals"), and a plurality of data lines $D_1$-$D_m$ transmitting data signals. The gate lines $G_1$-$G_n$ extend substantially in a row direction and substantially parallel to each other, while the data lines $D_1$-$D_m$ extend substantially in a column direction and substantially parallel to each other.

Each pixel includes a switching element Q connected to the signal lines $G_1$-$G_n$ and $D_1$-$D_m$, and a LC capacitor $C_{LC}$ and a storage capacitor $C_{ST}$ that are connected to the switching element Q. If unnecessary, the storage capacitor $C_{ST}$ may be omitted.

The switching element Q including a thin film transistor (TFT) is provided on the lower panel 100 and has three terminals: a control terminal connected to one of the gate lines $G_1$-$G_n$; an input terminal connected to one of the data lines $D_1$-$D_m$; and an output terminal connected to both the LC capacitor $C_{LC}$ and the storage capacitor $C_{ST}$.

The LC capacitor $C_{LC}$ includes a pixel electrode 190 provided on the lower panel 100 and a common electrode 270 provided on an upper panel 200 as two terminals. The LC layer 3 disposed between the two electrodes 190 and 270 functions as dielectric of the LC capacitor $C_{LC}$. The pixel electrode 190 is connected to the switching element Q, and the common electrode 270 is supplied with a common voltage Vcom and covers an entire surface of the upper panel 200. Unlike FIG. 2, the common electrode 270 may be provided on the lower panel 100, and both electrodes 190 and 270 may have shapes of bars or stripes.

The storage capacitor $C_{ST}$ is an auxiliary capacitor for the LC capacitor $C_{LC}$. The storage capacitor $C_{ST}$ includes the pixel electrode 190 and a separate signal line, which is provided on the lower panel 100, overlaps the pixel electrode 190 via an insulator, and is supplied with a predetermined voltage such as the common voltage Vcom. Alternatively, the storage capacitor $C_{ST}$ includes the pixel electrode 190 and an adjacent gate line called a previous gate line, which overlaps the pixel electrode 190 via an insulator.

For color display, each pixel uniquely represents one of primary colors (i.e., spatial division) or each pixel sequentially represents the primary colors in turn (i.e., temporal division) such that spatial or temporal sum of the primary colors are recognized as a desired color. An example of a set of the primary colors includes red, green, and blue and optionally white (or transparency). Another example of a set of the primary colors includes cyan, magenta, and yellow, which can be employed with or without red, green, and blue colors. FIG. 2 shows an example of the spatial division that each pixel includes a color filter 230 representing one of the primary colors in an area of the upper panel 200 facing the pixel electrode 190. Alternatively, the color filter 230 may be provided on or under the pixel electrode 190 on the lower panel 100.

One or more polarizers (not shown) are attached to at least one of the panels 100 and 200.

Referring to FIG. 1 again, the gray voltage generator 800 generates two sets of a plurality of gray voltages related to the transmittance of the pixels. The gray voltages in one set have a positive polarity with respect to the common voltage Vcom, while those in the other set have a negative polarity with respect to the common voltage Vcom.

The gate driver 400 is connected to the gate lines $G_1$-$G_n$. of the panel assembly 300 and synthesizes the gate-on voltage Von and the gate-off voltage Voff from an external device to generate gate signals for application to the gate lines $G_1$-$G_n$.

Figure 6:
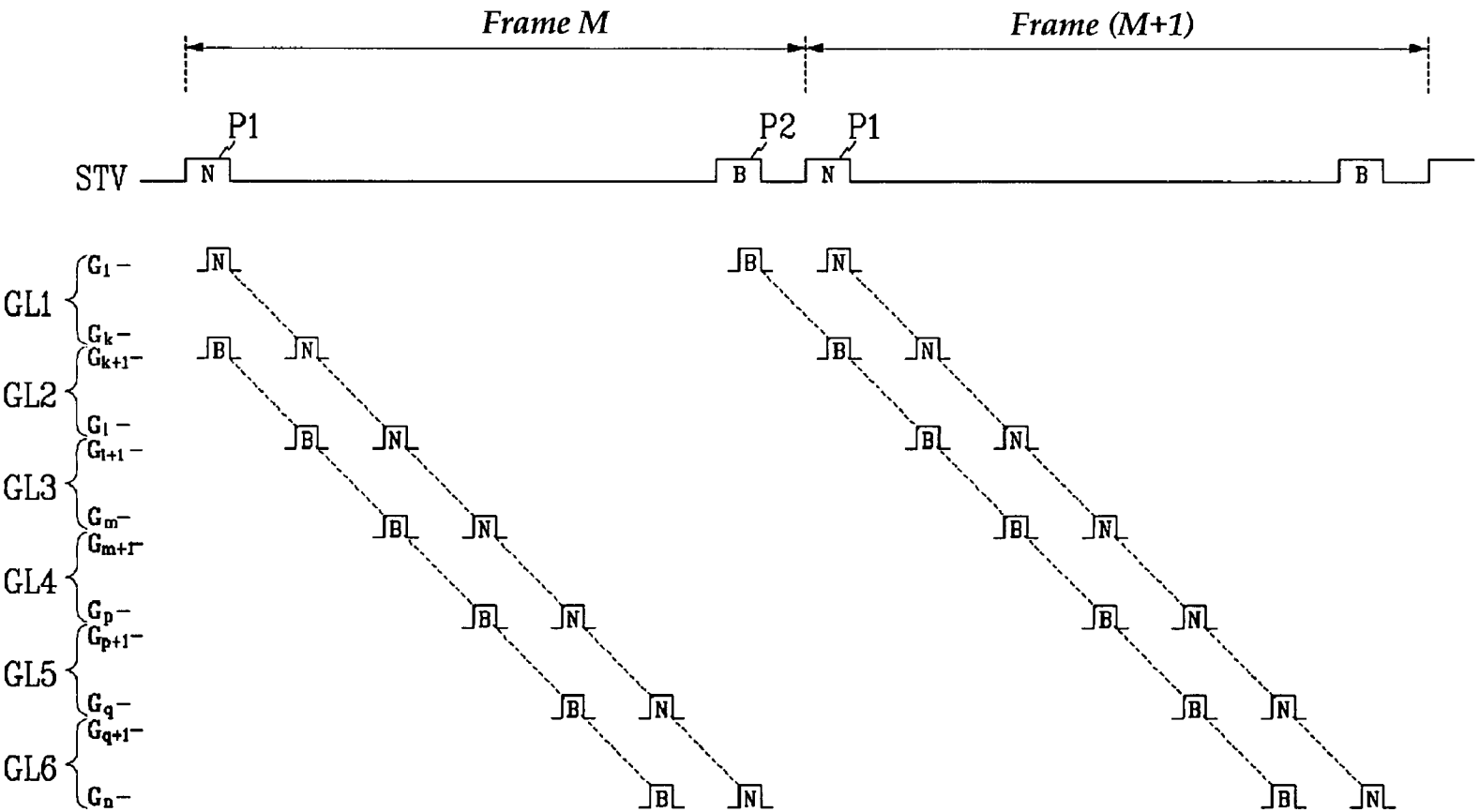
FIGS. 6-8 illustrate waveforms of a scanning start signal and gate signals for the duty ratios of 5:1, 4:2, and 2:4, respectively.
Figure 7:
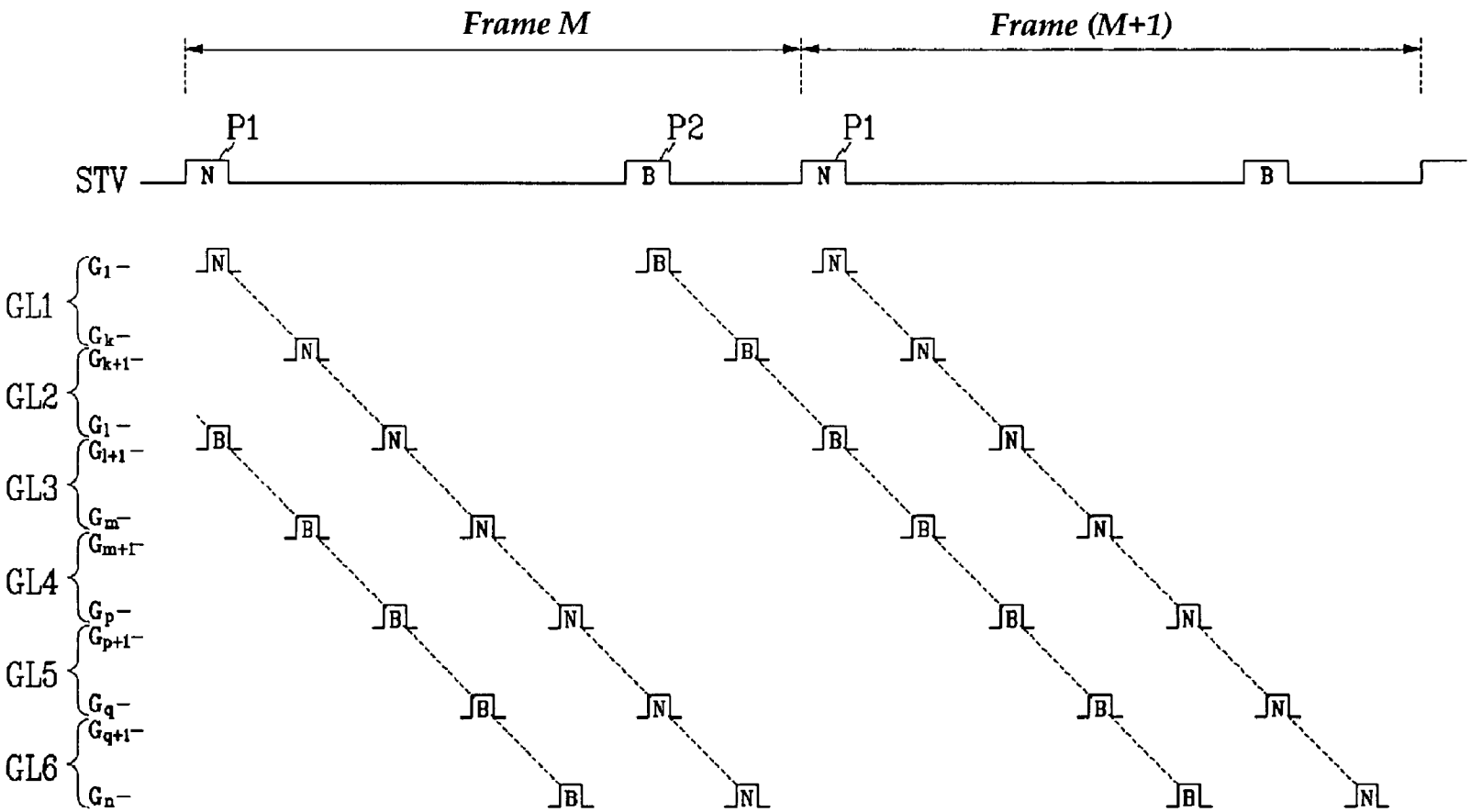
Figure 8:
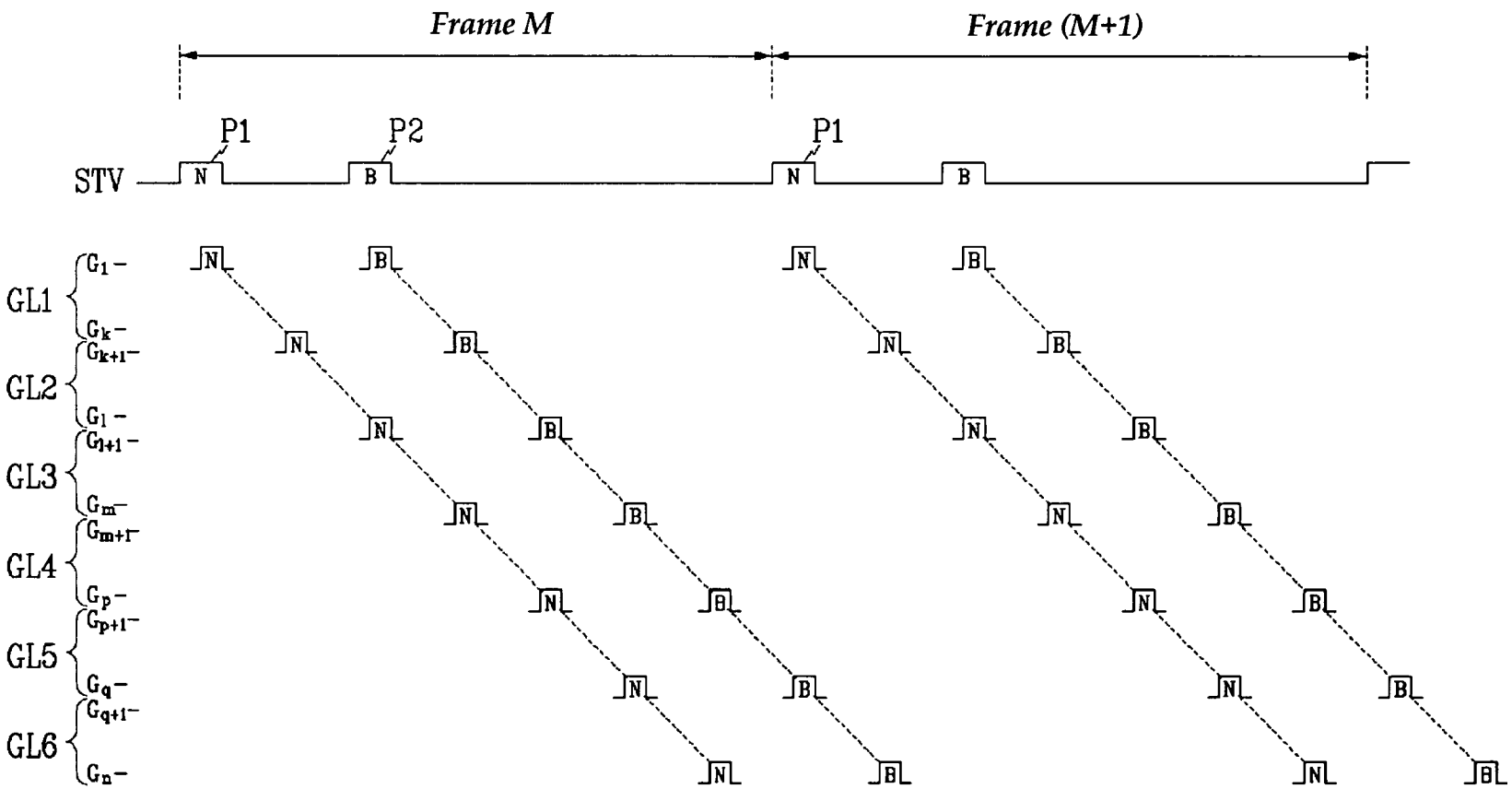

Referring to FIG. 1, the gate driver 400 includes six gate driving circuits 401-406 and the gate lines $G_1$-$G_n$ are grouped into six groups (GL1-GL6 as shown in FIGS. 6-8) connected to respective gate driving circuits 401-406. The number of the gate driving circuits may be varied.

The data driver 500 is connected to the data lines $D_1$-$D_m$ of the panel assembly 300 and applies data voltages, which are selected from the gray voltages supplied from the gray voltage generator 800, to the data lines $D_1$-$D_m$. The data driver 500 includes at least one data driving circuit (not shown).

The gate driving circuits 401-406 or the data driving circuit may be implemented as integrated circuit (IC) chip mounted on the panel assembly 300 or on a flexible printed circuit (FPC) film in a tape carrier package (TCP) type, which are attached to the LC panel assembly 300. Alternately, the drivers 400 and 500 may be integrated into the panel assembly 300 along with the display signal lines $G_1$-$G_n$ and $D_1$-$D_m$ and the TFT switching elements Q.

The duty ratio selector 710 is connected to the signal controller 600 and adjusts the ratio of an area charged with a black data and an area charged with normal data voltages during a frame.

The inversion selector 720 is connected to the signal controller 600 and selects inversion types.

The signal controller 600 controls the gate driver 400 and the gate driver 500.

Now, the operation of the above-described LCD will be described in detail.

The signal controller 600 is supplied with input image signals R, G and B and input control signals controlling the display thereof such as a vertical synchronization signal Vsync, a horizontal synchronization signal Hsync, a main clock MCLK, and a data enable signal DE, from an external graphics controller (not shown). In addition, the signal controller 600 receives a duty ratio selection signal and an inversion selection signal from the duty ratio selector 710 and the inversion selector 720, which are adjusted by a user.

After generating gate control signals CONT1 and data control signals CONT2 and processing the image signals R, G and B suitable for the operation of the panel assembly 300 on the basis of the input control signals, the input image signals R, G and B, the duty ratio selection signal, and the inversion selection signal. The signal controller 600 transmits the gate control signals CONT1 to the gate driver 400, and the processed image signals DAT and the data control signals CONT2 to the data driver 500.

The image signals DAT includes normal data generated depending on the input image signals R, G and B and black data for impulsive driving that make the luminance of the pixels minimum. The normal data and the black data are alternately outputted once for a horizontal period (referred to as "1H" and equal to a period of the horizontal synchronization signal Hsync or the data enable signal DE).

The gate control signals CONT1 include a scanning start signal STV for instructing to start scanning, a gate clock signal CPV for controlling the output time of the gate-on voltage Von, and a plurality of output enable signals for defining the duration of the gate-on voltage Von.

The data control signals CONT2 include a horizontal synchronization start signal STH for informing of start of data transmission for a group of pixels, a load signal LOAD for instructing to apply the data voltages to the data lines $D_1$-$D_m$, and a data clock signal HCLK. The data control signal CONT2 may further include an inversion signal RVS for reversing the polarity of the data voltages (with respect to the common voltage Vcom).

Responsive to the data control signals CONT2 from the signal controller 600, the data driver 500 receives a packet of the normal data or the black data for the group of pixels from the signal controller 600, converts the normal data or the black data into analog data voltages selected from the gray voltages supplied from the gray voltage generator 800, and applies the data voltages to the data lines $D_1$-$D_m$.

The gate driver 400 applies the gate-on voltage Von to the gate line $G_1$-$G_n$ in response to the gate control signals CONT1 from the signal controller 600, thereby turning on the switching elements Q connected thereto. The data voltages applied to the data lines $D_1$-$D_m$ are supplied to the pixels through the activated switching elements Q.

The difference between the data voltage and the common voltage Vcom is represented as a voltage across the LC capacitor $C_{LC}$, which is referred to as a pixel voltage. The LC molecules in the LC capacitor $C_{LC}$ have orientations depending on the magnitude of the pixel voltage, and the molecular orientations determine the polarization of light passing through the LC layer 3. The polarizer(s) converts the light polarization into the light transmittance.

By repeating this procedure by a unit of the horizontal period, all gate lines $G_1$-$G_n$ are sequentially supplied with the gate-on voltage Von during a frame (or a vertical period), thereby applying the data voltages to all pixels. When the next frame starts after finishing one frame, the inversion control signal RVS applied to the data driver 500 is controlled such that the polarity of the data voltages is reversed (which is referred to as "frame inversion"). The inversion control signal RVS may be also controlled such that the polarity of the data voltages flowing in a data line in one frame are reversed (for example, line inversion and dot inversion), or the polarity of the data voltages in one packet are reversed (for example, column inversion and dot inversion), which may be determined by the inversion selection signal.

Next, an impulsive driving of an LCD according to an embodiment of the present invention will be described in detail with reference to FIGS. 1 and 3-8.

Figure 3:
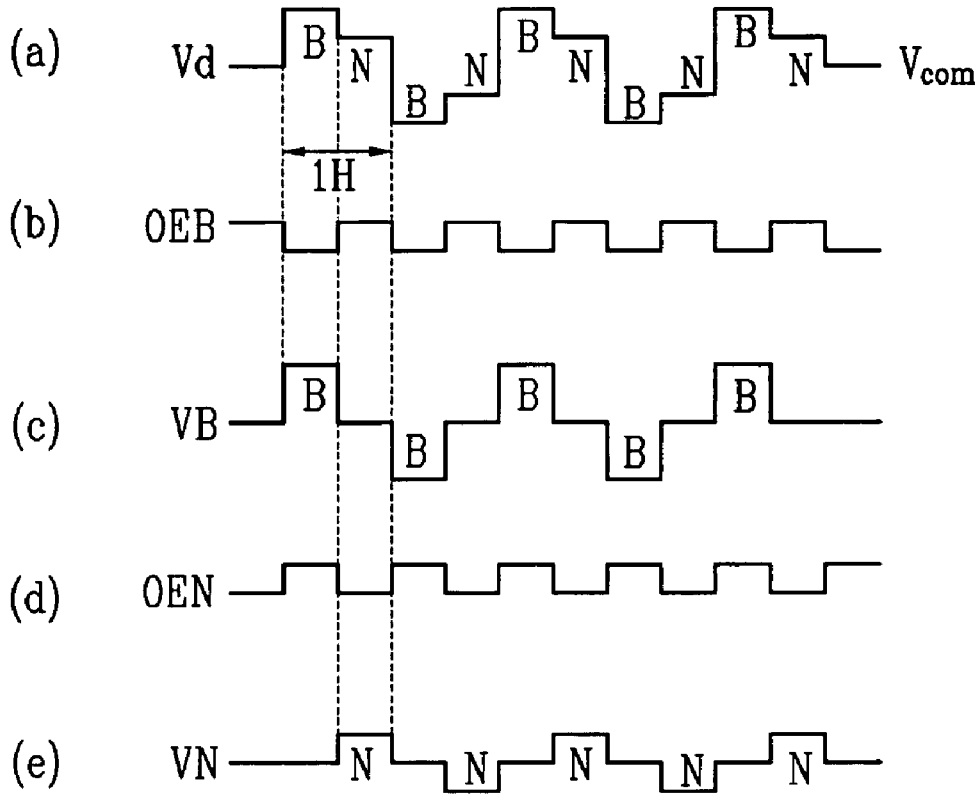
FIG. 3 shows waveforms of various signals for an LCD according to an embodiment of the present invention.
Figure 4:
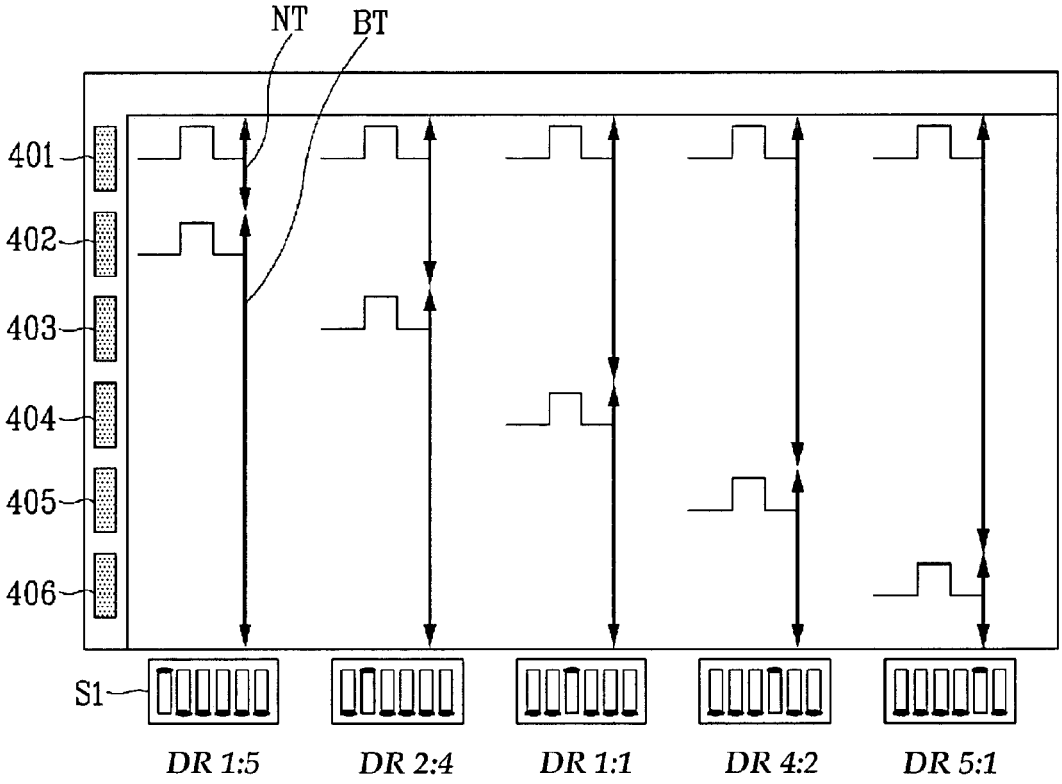
FIG. 4 illustrates the states of an exemplary duty ratio selector and the generation time of the gate-on voltage for black data.
Figure 5:
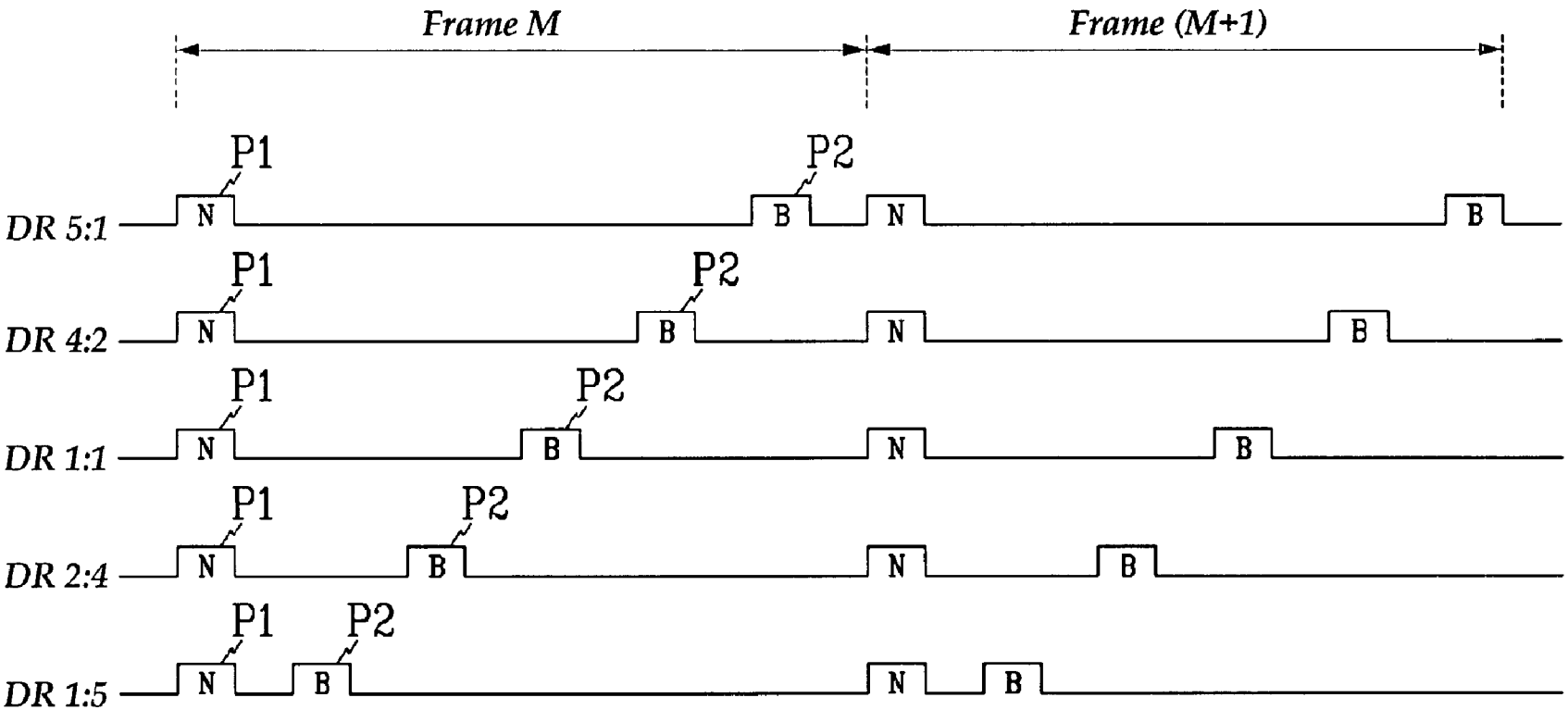
FIG. 5 shows waveforms of a scanning start signal for various duty ratios.

FIG. 3 shows waveforms of various signals for an LCD according to an embodiment of the present invention, which includes a data voltage Vd, output enable signals OEB and OEN having a black data waveform and a normal data waveform, respectively, and black and normal data voltages VB and VN defined by the output enable signals OEB and OEN, respectively. FIG. 4 illustrates the states of an exemplary duty ratio selector and the generation time of the gate-on voltage for black data, FIG. 5 shows waveforms of a scanning start signal for various duty ratios, and FIGS. 6-8 illustrate waveforms of a scanning start signal and gate signals for the duty ratios of 5:1, 4:2, and 2:4, respectively.

In FIGS. 3-8, reference numerals N and B indicate signals, pulses, or voltages related to normal data and black data, respectively, and FIGS. 5-8 show the signals for an M-th frame and an (M+1)-th frame and first to sixth gate lines groups GL1-GL6 including gate lines $G_1$-$G_k$, gate lines $G_{k+1}$-$G_l$, gate lines $G_{1+1}$-$G_m$, gate lines $G_{m+1}$-$G_p$, gate lines $G_{p+1}$-$G_q$, and gate lines $G_{q+1}$-$G_n$, respectively.

As described above, the signal controller 600 supplies image data DAT including normal data and black data to the data driver 500 in an alternate manner, and it also supplies a scanning start signal STV, output enable signals, and a gate clock signal CPV to the gate driver 400 to perform scanning.

Referring to (a) in FIG. 3, a data voltage Vd includes normal data voltages corresponding to the normal data and a black data voltage corresponding to the black data. The normal data voltages precede the black data voltage and the sum of the duration of a normal data voltage and the duration of the black data voltage equal to 1H. The ratio of the durations of the normal and black data voltages can be adjusted as required. The value of the black data voltage relative to the common voltage Vcom is equal to or higher than those of the normal data voltages relative to the common voltage Vcom, which may be appropriate for a normally white mode LCD. A normally black mode LCD may have a black data voltage (relative to the common voltage Vcom) equal to or lower than normal data voltages (relative to the common voltage Vcom).

The six output enable signals are provided for respective gate driving circuits 401-406 to limit the duration of the gate-on voltage Von outputted from the gate driving circuits 401-406. Referring to (b) and (d) in FIG. 3, each of the output enable signals has two waveforms including a normal data waveform OEN and a black data waveform OEB, which alternate at appropriate times under the control of the signal controller 600, and the two waveforms OEN and OEB are reversed to form each other and have a period equal to one horizontal period. As shown in FIG. 3, a high level of the output enable signals represses the output of the gate-on voltage Von to make the gate-off voltage Voff output, while a lower level thereof enables to output the gate-on voltage Von. When the output enable signals have a black data waveform OEB, the black data voltage are applied to the pixels during the application of the gate-on voltage Von as shown in (c) in FIG. 3, while the normal voltages are applied to the pixels during the application of the gate-on voltage Von when the output enable signals have a normal data waveform as shown in (e) in FIG. 3.

The ratio of the durations of the high level and the low level of the output enable signals is adjusted depending on the ratio of the duration of the normal data voltage and the duration of the black data voltage and the high level and the low level may perform exchanged functions.

Referring to FIG. 5, the scanning start signal STV includes normal data pulses P1 for the normal data and black data pulses P2 for the black data. One normal data pulse P1 and one black data pulse P2 are generated in one frame.

The application time of the black data voltage is adjustable using the duty ratio selector 710 shown in FIG. 1. Referring to FIG. 4, the duty ratio selector 710 includes a switching unit S1 including a plurality of dip switches or remote control switches, etc. The signal controller 600 controls the time of generating the black data pulses P2 of the scanning start signal STV based on the duty ratio selection signal supplied from the duty ratio selector 710. Reference numerals NT and BT shown in FIG. 4 denote the distances (or areas) occupied by the normal data voltages and the black data voltage when the scanning of the gate-on voltage Von for black data starts after the scanning of the gate-on voltage Von for normal data starts.

Referring to FIGS. 4 and 5, when a user determines that the duty ratio is equal to 5:1 using the switching unit S1, the black data pulse P2 is generated when ⅚ vertical period elapses after the normal data pulse P1 is generated. Therefore, when the first gate driving circuit 401 starts to apply the gate-on voltage Von for normal data in synchronization with the normal data pulse P1, the second gate driving circuit 402 starts to apply the gate-on voltage Von for black data. If the duty ratio is equal to 4:2, the black data pulse P2 is generated when ⅔ vertical period elapses after the normal data pulse P1 is generated, and, if the duty ratio is determined to be equal to 1:1, the black data pulse P2 is generated when ⅓ vertical period elapses after the normal data pulse P1 is generated. Similarly, the black data pulse P2 is generated when ⅔ vertical period elapses after the normal data pulse P1 is generated if the duty ratio is determined to be equal to 2:4, and the black data pulse P2 is generated when ⅙ vertical period elapses after the normal data pulse P1 is generated if the duty ratio is determined to be equal to 1:5.

Since the generation time of the black data pulse P2 is varied depending on the duty ratio as describe above, a different gate driving circuit starts to apply the gate-on voltage Von for black data depending on the duty ratio when the first gate driving circuit 401 starts to apply the gate-on voltage Von for normal data.

The above-described operation for a duty ratio of 5:1 will be described more in detail.

First, the signal controller 600 generates a normal data pulse P1 at the scanning start signal STV supplied to the first gate driving circuit 401.

When ⅚ vertical period elapses after the generation of the normal data pulse P1, the signal controller 600 generates a black data pulse P2 at the scanning start signal STV. At this time, an output enable signal applied to the first gate driving circuit 401 by the signal controller 600 has the normal data waveform OEN, while the output enable signals applied to the second to the sixth gate driving circuits 402-406 have the black data waveform OEB.

After receiving the pulses P1 of the scanning start signal STV, the first gate driving circuit 401 sequentially outputs the gate-on voltage Von, which maintains a duration within the duration of the normal data voltage according to the output enable signal, from a gate line $G_1$ connected to a first output terminal thereof. Therefore, the pixels connected to the gate lines $G_1$-$G_n$ are charged with their data voltages sequentially from the first row.

When ⅙ vertical period elapses after the generation of the pulse P1, the first gate driving circuit 401 outputs the gate-on voltage Von to the k-th gate line $G_k$ connected to its last output terminal and then, outputs a carry signal to the second gate driving circuit 402.

At this time, the signal controller 600 changes the waveform of the output enable signal, which is supplied to the second gate driving circuit 402, from the black data waveform OEB into the normal data waveform OEN. However, the waveforms of the output enable signals supplied to the third to the sixth gate driving circuits 403-406 are maintained. Accordingly, the output enable signal for the first gate driving circuit 401 and the output enable signal for the second gate driving circuit 402 have the normal data waveform OEN.

In this way, five gate driving circuits from the first gate driving circuit 401 to the fifth gate driving circuit 405 sequentially apply the gate-on voltage Von for normal data to the gate lines $G_1$-$G_q$ connected to output terminals thereof, thereby charging the pixels connected to the gate lines $G_1$-$G_q$ with their own data voltages.

The signal controller 600 loads a black data pulse P2 on the scanning start signal STV to send to the first gate driving circuit 401 when the fifth gate driving circuit 405 outputs the gate-on voltage Von to the gate line $G_q$ connected to its last output terminal and, then, outputs a carry signal to the sixth gate driving circuit 406. At this time, the signal controller 600 reverses the waveform of the output enable signal supplied to the first gate driving circuit 401 from the black data waveform OEB to the normal data waveform.

The first gate driving circuit 401 receiving the black data pulse P2 of the scanning start signal STV begins scanning the gate-on voltage Von for the black data, which maintains a duration within the duration of the black data voltage according to the output enable signal. Therefore, the pixels connected to the gate lines $G_1$-$G_k$ are charged with the black data voltage to obtain impulsive driving.

At the same time, the sixth gate driving circuit 406 starts scanning the gate-con voltage Von for normal data.

When the pixels connected to the last output terminals of the first and the sixth gate driving circuits 401 and 406 finish the charging of the black data voltage and the normal data voltages, a frame is completed and at this time, the ratio of an area occupied by the pixels charged with the normal data voltages and an area occupied by the pixels charged with the black data voltage is equal to 5:1.

When the scanning of the normal data voltages for a frame are completed in this way, the signal controller 600 generates the normal data pulse P1 at the scanning start signal STV for scanning of the normal data voltages for a next frame. At the same time, the signal controller 600 changes the output enable signal applied to the first gate driving circuit 401 from the black data waveform OEB to the normal data waveform OEN.

In the meantime, the first gate driving circuit 401 generates a carry signal for the black data voltage to output to the second gate driving circuit 402, the signal controller 600 changes the output enable signal applied to the second gate driving circuit 402 from the normal data waveform OEN to the black data waveform OEB.

Accordingly, the scanning of the normal data voltages for the next frame starts from the first gate driving circuit 401, while the scanning of the black data voltage for the next frame starts from the second gate driving circuit 402.

In this way, depending on the duty ratio determined by the duty ratio selector 710, the signal controller 600 controls the generation time of the black data pulse P2 of the scanning start signal STV and the waveforms of the output enable signals supplied to the respectively gate driving circuits 401-406 as shown in FIG. 5 such that the ratio of an area for the normal data voltages and an area for the black data voltage is determined by the duty ratio.

FIGS. 7 and 8 show the scanning start signal STV and the gate-on voltage Von generated by the gate driving circuits 401-406 for duty ratios of 4:2 and 2:4, respectively.

Referring to FIGS. 7 and 8, the scanning of the gate-on voltage Von for black data starts from the third gate driving circuit 403 when the duty ratio is equal to 4:2, while the scanning of the gate-on voltage Von for black data starts from the fifth gate driving circuit 405 when the duty ratio is equal to 2:4.

The number of the gate driving circuits and the number of the available duty ratios may be varied and, in addition, the application time of the black data voltage may be varied in a single gate driving circuit.

When the charging time for the normal data voltages is insufficient, precharging may be added to the charging of the normal and the black data voltages.

In the meantime, a user can select the type of inversion of the data voltages Vd such as one dot inversion or two dot inversion using the inversion selector 720 in consideration of image type including still image and motion image, image clearness or power consumption. For this purpose, an internal storage device (not shown) in the signal controller 600 or a separate storage device (not shown) such as read-only memory (ROM) may store information required for one or two dot inversion. The signal controller 600 reads out the information required for the inversion type selected by the user from internal or external memory, and it controls the inversion control signal RVS to obtain the selected inversion. The available inversion types may be varied.

As described above, the output enable signals are assigned to respective gate driving circuits such that both the normal data voltages and the black data voltage are applied to the pixels in one frame and thus a frame memory for storing the black data is not required to reduce the manufacturing cost. The ratio of an area for the normal data voltages and an area for the black data voltage is adjustable without changing a driving frequency by varying the application time of the black data according to the selection of the user, thereby realizing various output images.

In addition, the inversion type can be made by the user in consideration of image type or power consumption to satisfy the user.

The above described impulsive driving can be an optically compensated birefringence (OCB) mode LCD. In this case, the black data voltage is periodically applied before a bend arrangement is broken. Accordingly, a low voltage range, which gives higher transmittance, but was not used due to the break of the bend arrangement, can be used to increase the transmittance of the LCD.

Although preferred embodiments of the present invention have been described in detail hereinabove, it should be clearly understood that many variations and/or modifications of the basic inventive concepts herein taught which may appear to those skilled in the present art will still fall within the spirit and scope of the present invention, as defined in the appended claims.

What is claimed is:

1. An impulsive driving liquid crystal display comprising:

a plurality of groups of gate lines transmitting a gate-on voltage;

a plurality of data lines alternately transmitting normal data voltages and an impulsive data voltage;

a plurality of pixels arranged in a matrix and including switching elements that are connected to the gate lines and the data lines and turn on in response to the gate-on voltage to transmit the data voltages;

a plurality of gate driving circuits connected to respective groups of gate lines and sequentially applying the gate-on voltage to the gate lines;

a data driver applying the data voltages to the data lines;

a duty ratio selector outputting a duty ratio selection signal informing a selected duty ratio; and a signal controller controlling the plurality of gate driving circuits and the data driver based on the duty ratio selection signal, wherein the signal controller determines a time for the pixels to receive the impulsive data voltage based on the duty ratio selection signal, and controls the plurality of gate driving circuits based on the determined time, and wherein sum of the application durations of the normal data voltages and the impulsive data voltage adjacent to each other is equal to one horizontal period.

2. The liquid crystal display of claim 1, wherein the signal controller supplies a plurality of output enable signals defining duration of the gate-on voltage to respective gate driving circuits.

3. The liquid crystal display of claim 2, wherein each of the output enable signals has a first waveform for blocking the impulsive data voltage and a second waveform for blocking the normal data voltages.

4. The liquid crystal display of claim 3, wherein at least one of the output enable signals has the first waveform and at least one of the output enable signals has the second waveform.

5. The liquid crystal display of claim 4, wherein the signal controller assigns the first waveform to the output enable signals for a first group of the gate driving circuits and the second waveform to the output enable signals for a second group of the gate driving circuits depending on the duty ratio selection signal, each of the first and second groups of the gate driving circuits comprising at least one of the gate driving circuits.

6. The liquid crystal display of claim 5, wherein the signal controller supplies a scanning start signal instructing to start scanning of the gate-on voltage to one of the gate driving circuits, the scanning start signal includes first data pulses and second data pulses, the first data pulses are spaced apart from each other by a predetermined time irrespective of the duty ratio selection signal, and the signal controller determines a distance between the first data pulses and the second data pulses by the duty ratio selection signal.

7. The liquid crystal display of claim 1, wherein the signal controller supplies a scanning start signal instructing to start scanning of the gate-on voltage to one of the gate driving circuits, the scanning start signal includes normal data pulses for the application of the normal data voltages and impulsive data pulses for the application of the impulsive data voltage, and the signal controller varies generation time of the impulsive data pulses of the scanning start signal depending on the duty ratio selection signal.

8. The liquid crystal display of claim 1, wherein the duty ratio selector comprises a plurality of dip switches.

9. The liquid crystal display of claim 1, further comprising an inversion selector outputting an inversion selection signal informing a selected inversion type to the signal controller.

10. The liquid crystal display of claim 9, wherein the signal controller supplies an inversion signal for inversion of polarity of the data voltages to the data driver and the inversion signal is varied depending on the inversion selection signal.

11. The liquid crystal display of claim 10, wherein the inversion type includes one dot inversion and two dot inversion.

12. The liquid crystal display of claim 1, wherein the impulsive data voltage comprises a white data voltage.

13. The liquid crystal display of claim 1, wherein the impulsive data voltage comprises a black data voltage.

14. An impulsive driving liquid crystal display comprising:

a plurality of groups of gate lines transmitting a gate-on voltage;

a plurality of data lines alternately transmitting normal data voltages and an impulsive data voltage;

a plurality of pixels arranged in a matrix and including switching elements that are connected to the gate lines and the data lines and turn on in response to the gate-on voltage to transmit the data voltages;

a plurality of gate driving circuits connected to respective groups of gate lines and sequentially applying the gate-on voltage to the gate lines; and a data driver applying the data voltages to the data lines, wherein the pixels include first and second pixels connected to different gate driving circuits through the gate lines, the first and the second pixels are supplied with the normal data voltages and the impulsive data voltage, respectively, the second pixels are determined by the duty ratio selection signal, and a sum of the application durations of the normal data voltages and the impulsive data voltage adjacent to each other is equal to one horizontal period.

15. A method of impulsive driving a liquid crystal display including a plurality of pixels, the pixels arranged in a matrix and including switching elements connected to gate lines and data lines using a plurality of gate driving circuits that apply a gate-on voltage for turning on the switching elements to the gate lines, the method comprising:

determining a starting time for applying an impulsive data voltage based on supplied information;

alternately applying normal data voltages and the impulsive data voltage;

applying the gate-on voltage to the gate lines to supply the normal data voltages to the pixels connected thereto; and applying the gate-on voltage to at least one of the gate lines to supply the impulsive data voltage to the pixels connected thereto, wherein a sum of the application durations of the normal data voltages and the impulsive data voltage adjacent to each other is equal to one horizontal period.

* * * * *